US008861991B2

(12) United States Patent
Kubota et al.

(10) Patent No.: US 8,861,991 B2
(45) Date of Patent: Oct. 14, 2014

(54) DEVELOPER AMOUNT DETECTOR, AND DEVELOPER CONTAINER, DEVELOPMENT DEVICE, AND IMAGE FORMING APPARATUS INCORPORATING SAME

(75) Inventors: Tomohiro Kubota, Osaka (JP); Naoki Nakatake, Hyogo (JP); Hirobumi Ooyoshi, Osaka (JP); Tomofumi Yoshida, Osaka (JP); Yoshiyuki Shimizu, Hyogo (JP); Manabu Hamada, Osaka (JP); Shoh Tsuritani, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 178 days.

(21) Appl. No.: 13/352,732

(22) Filed: Jan. 18, 2012

(65) Prior Publication Data

US 2012/0189327 A1 Jul. 26, 2012

(30) Foreign Application Priority Data

Jan. 26, 2011 (JP) ..... 2011-014215

(51) Int. Cl.
*G03G 15/08* (2006.01)

(52) U.S. Cl.
CPC .... *G03G 15/0831* (2013.01); *G03G 2215/0891* (2013.01); *G03G 2215/0827* (2013.01)
USPC ..... 399/27; 399/30; 399/58; 399/62; 399/119

(58) Field of Classification Search
USPC ..... 399/27, 111, 258, 119, 35, 227
See application file for complete search history.

(56) References Cited

U.S. PATENT DOCUMENTS

| | | | |
|---|---|---|---|
| 7,965,957 | B2 | 6/2011 | Kubota et al. |
| 2003/0086715 | A1 | 5/2003 | Miura et al. |
| 2004/0001723 | A1 | 1/2004 | Ashida et al. |
| 2007/0147857 | A1 | 6/2007 | Shin et al. |

(Continued)

FOREIGN PATENT DOCUMENTS

| | | | |
|---|---|---|---|
| CN | 1609727 | A | 4/2005 |
| CN | 1987676 | A | 6/2007 |

(Continued)

OTHER PUBLICATIONS

U.S. Appl. No. 13/351,191, filed Jan. 17, 2012, Kubota et al.

(Continued)

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A development device includes a development housing, a first developer conveyance member, a developer bearer, and a developer amount detector to detect an amount of developer in the development housing. The developer amount detector includes a light-emitting element, a right-receiving element, a first light guide including a first end from which light enters and a second end disposed inside the development housing, and a second light guide including a first end positioned inside the development housing across a predetermined distance from the second end of the first light guide and a second end from which the light exits. The second end of the first light guide and the first end of the second light guide are arranged in an axial direction of the first developer conveyance member with a light transmission path therebetween partly inside a locus of rotation of the first developer conveyance member.

18 Claims, 5 Drawing Sheets

(56) References Cited

U.S. PATENT DOCUMENTS

| | | | | |
|---|---|---|---|---|
| 2008/0181627 | A1* | 7/2008 | Bae | 399/27 |
| 2008/0285986 | A1 | 11/2008 | Wada et al. | |
| 2008/0286005 | A1* | 11/2008 | Ushikubo | 399/119 |

FOREIGN PATENT DOCUMENTS

| | | | |
|---|---|---|---|
| CN | 101592898 | A | 12/2009 |
| JP | 2005-345914 | | 12/2005 |
| JP | 2007-147764 | | 6/2007 |
| JP | 2007-219269 | | 8/2007 |
| JP | 2008-122703 | A | 5/2008 |

OTHER PUBLICATIONS

Combined Office Action and Search Report issued May 27, 2013 in Chinese Patent Application No. 201110434112.4 with English translation of category of cited documents.

U.S. Appl. No. 13/344,940, filed Jan. 6, 2012, Tomofumi Yoshida, et al.

Japanese Office Action issued Aug. 18, 2014, in JP Application No. 2011-014215.

* cited by examiner

DEVELOPER AMOUNT DETECTOR, AND DEVELOPER CONTAINER, DEVELOPMENT DEVICE, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2011-014215, filed on Jan. 26, 2011, in the Japan Patent Office, the entire disclosure of which is hereby incorporated by reference herein.

FIELD OF THE INVENTION

The present invention generally relates to a developer amount detector, and a development device, a process unit, and an image forming apparatus including a developer amount detector.

BACKGROUND OF THE INVENTION

There are image forming apparatuses, such as copiers, printers, facsimile machines, or multifunction machines including at least two of these functions, that include process units in which a development device, a toner cartridge, and photoreceptor are housed in a common unit casing as a modular unit removably installable in a main body of the image forming apparatus. Developer contained in process units is consumed in image development, and accordingly it is necessary to notify users when to replace the process unit.

Therefore, various types of detectors have been proposed to detect the amount of developer in a developer container in process units. For example, light transmission-type detectors including optical elements are used to detect the amount of developer. Light transmission-type developer amount detectors radiate light inside the developer container and determine the amount of developer therein based on the duration of time necessary for the light to transverse the developer container or the timing at which the light is detected.

For example, JP-2007-147764-A, JP-2005-345914-A, and JP-2007-219269-A propose light transmission-type developer amount detectors that include a light-emitting element, a light-receiving element, and first and second light guides. The light-emitting element and the light-receiving element are provided in the main body of the image forming apparatus. The first and second light guides are provided in the process unit and can be constructed of a prism, a mirror, or the like. The light emitted from the light-emitting element is guided by the first light guide into the developer container inside the process unit. Then, the second light guide guides the light out of the developer container to the light-receiving element.

When the amount of developer in the developer container is sufficient, the light is blocked by the developer, and the light-receiving element does not receive the light. By contrast, when the amount of developer in the developer container is reduced to or below a reference amount, the light can reach the light-receiving element. With the output from the light-receiving element at that time, it can be determined that the amount of developer has decreased below the reference amount.

Developer containers typically include a developer conveyance member such as a screw to transport the developer therein, thereby preventing local shortage of developer, even when images in which printing ratio is locally high are printed in succession, and a greater amount of developer is consumed in areas for forming such areas of high printing ratio. Detection accuracy of light transmission-type developer amount detectors, however, can be degraded in configurations in which developer is thus transported.

FIG. 9 is an end-on axial view of a development device that includes a developer conveyance screw and a developer amount detector according to a related art.

The development device shown in FIG. 9 includes a development housing 200 containing developer (toner) T, a screw 300 to transport the developer T, and first and second light guides 400 and 500. In this configuration, the light emitted from the light-emitting element is guided by the first light guide 400 into the development housing 200. At that time, if the toner T is present between the first and second light guides 400 and 500, the light is blocked. By contrast, if the toner T is not present between the first and second light guides 400 and 500, the light can pass through the second light guide 500 and reach the light-receiving element.

As the screw 300 rotates, the toner T is transported in the direction perpendicular to the surface of the paper on which FIG. 9 is drawn, and rotation of the screw 300 makes a surface J of the toner T slant as shown in FIG. 9. Although toner has a certain degree of fluidity, it is lower than that of liquid such as water. Accordingly, the surface J of the toner T does not keep the slant state but fluctuates even when the amount of the toner T does not change. If the slant surface J of the toner T positioned in a light transmission path L between the first light guide 400 and the second light guide 500 fluctuates as shown in FIG. 9 as the screw 300 rotates, the degree of light transmission varies, resulting in detection error. In other words, in the configuration in which the light transmission path L between the first light guide 400 and the second light guide 500 is perpendicular to the axis of the screw 300 as shown in FIG. 9, the degree of light transmission is susceptible to fluctuations in the surface of the toner T. Thus, it is difficult to attain a high degree of accuracy in detection of the toner amount.

BRIEF SUMMARY OF THE INVENTION

In view of the foregoing, one embodiment of the present invention provide a development device that includes a development housing for containing developer, a first developer conveyance member disposed in the development housing to transport by rotation the developer therein, a developer bearer to carry by rotation the developer contained in the development housing to a development range facing a latent image bearer, and a developer amount detector to detect an amount of developer contained in the development housing.

The developer amount detector includes a light-emitting element to emit light, a light-receiving element, and first and second light guides. The light emitted from the light-emitting element enters the first light guide from a first end and exits from a second end of the first light guide. The second end of the first light guide is disposed inside the development housing. The second light guide includes a first end positioned inside the development housing, facing the second end of the first light guide across a predetermined distance. The light enters the second light guide from the first end and exits from a second end of the second light guide. The second end of the first light guide and the first end of the second light guide are arranged in an axial direction of the first developer conveyance member, forming a light transmission path therebetween, and the light transmission path is positioned partly inside a locus of rotation of the first developer conveyance member.

In another embodiment, a developer container includes the developer conveyance member and the developer amount detector described above.

Yet in another embodiment, an image forming apparatus includes a latent image bearer on which a latent image is formed and the development device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
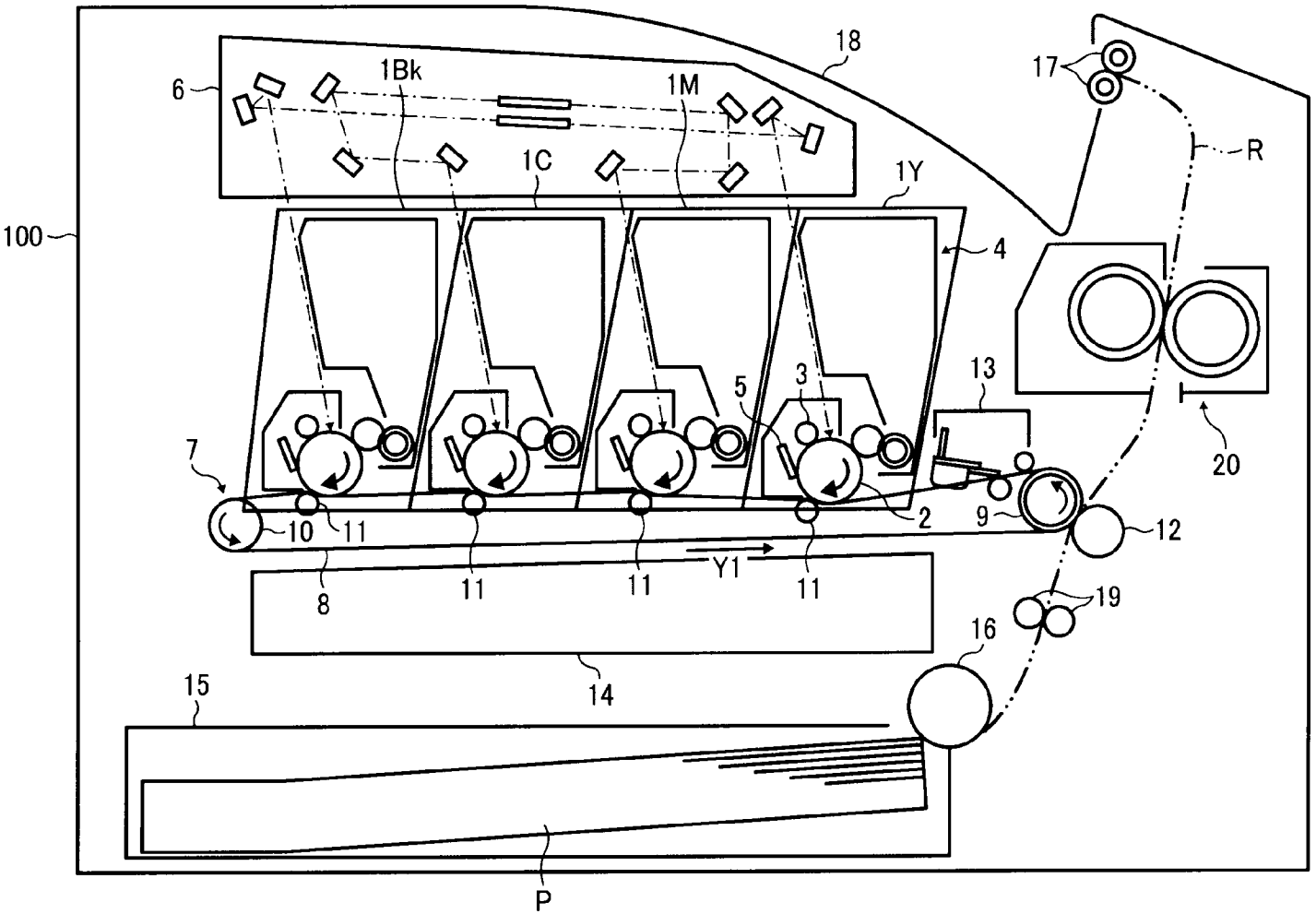
FIG. 1 is a schematic view of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Referring to FIG. 1, a configuration and operation of an image forming apparatus according to an embodiment is described below.

An image forming apparatus 100 shown in FIG. 1 can be, for example, a multicolor laser printer and includes four process units 1Y, 1M, 1C, and 1Bk removably installable in an apparatus body thereof. The process units 1Y, 1M, 1C, and 1Bk respectively contain yellow (Y), magenta (M), cyan (C), and black (Bk) developer corresponding to decomposed color components of full-color images and have a similar configuration except the color of developer contained therein. It is to be noted that one-component developer consisting essentially of toner particles is used in the present embodiment.

More specifically, each process unit 1 includes a drum-shaped photoreceptor 2 serving as a latent image bearer, a changing device including a changing roller 3 to charge the surface of the photoreceptor 2, a development device 4 to supply toner to the surface of the photoreceptor 2, and a cleaning unit including a cleaning blade 5 to clean the surface of the photoreceptor 2. It is to be noted that, in FIG. 1, the photoreceptor 2, the charging roller 3, the development device 4, and the cleaning blade 5 of only the process unit 1Y for yellow are given reference numerals, and reference numerals of those of the other process units 1M, 1C, and 1Bk are omitted.

Additionally, an exposure unit 6 is provided above the process units 1 in FIG. 1 to expose to light the surface of each photoreceptor 2. The exposure unit 6 includes a light source, a polygon mirror, an f-θ lens, and reflection mirrors, and is configured to direct a laser beam onto the surface of the photoreceptor 2 according to image data.

Additionally, a transfer device 7 is provided beneath the process units 1. The transfer device 7 includes an intermediate transfer belt 8 that can be, for example, an endless belt onto and from which an image is transferred. The intermediate transfer belt 8 is stretched around support rollers, namely, a driving roller 9 and a driven roller 10. As the driving roller 9 rotates counterclockwise in FIG. 1, the intermediate transfer belt 8 rotates in the direction indicated by arrow Y1 shown in FIG. 1.

The image forming apparatus 100 further includes four primary-transfer rollers 11 positioned facing the respective photoreceptors 2 via the intermediate transfer belt 8. Each primary-transfer roller 11 is pressed against an inner circumferential surface of the intermediate transfer belt 8, thus forming a primary-transfer nip between the intermediate transfer belt 8 and the corresponding photoreceptor 2. Each primary-transfer roller 11 is electrically connected to a power source and receives a predetermined amount of voltage including at least one of direct-current (DC) voltage and alternating current (AC) voltage.

Additionally, a secondary-transfer roller 12 is provided at a position facing the driving roller 9 via the intermediate transfer belt 8. The secondary-transfer roller 12 is pressed against an outer circumferential surface of the intermediate transfer belt 8, and thus a secondary-transfer nip is formed between the secondary-transfer roller 12 and the intermediate transfer belt 8. Similarly to the primary-transfer rollers 11, the secondary-transfer roller 12 is electrically connected to a power source and receives a predetermined amount of voltage including at least one of DC voltage and AC voltage.

Additionally, a belt cleaning unit 13 to clean the surface of the intermediate transfer belt 8 is provided facing a right end portion of the intermediate transfer belt 8 from the outer circumferential side in FIG. 1. A waste toner conveyance hose (tube) is connected to the belt cleaning unit 13 as well as an inlet of a waste toner container 14 provided beneath the transfer device 7.

The image forming apparatus 100 further includes a sheet cassette 15 for containing sheets P of recording media such as paper or overhead projector (OHP) films, provided beneath the apparatus body, a pair of discharge rollers 17, and a discharge tray 18. The sheet cassette 15 is provided with a feed roller 16 to pick up and transport the sheets P from the sheet cassette 15. The pair of discharge rollers 17 is positioned in an upper portion of the apparatus body to discharge the sheets P outside the image forming apparatus 100, and the sheets P thus discharged are stacked on the discharge tray 18 formed on an upper surface of the apparatus body.

A conveyance path R is formed inside the apparatus body, and the sheet P is conveyed from the sheet cassette 15 to the secondary-transfer nip and further to the discharge tray 18 along the conveyance path R. Along the conveyance path R, a pair of registration rollers 19 are positioned upstream from the secondary-transfer roller 12 in the direction in which the sheet P is transported (hereinafter "sheet conveyance direction"), and a fixing device 20 is positioned downstream from the secondary-transfer roller 12 in that direction.

Additionally, the image forming apparatus 100 includes a controller that performs various types of control processing by executing programs stored in a memory. The controller may be a computer including a central processing unit (CPU) and associated memory units (e.g., ROM, RAM, etc).

The image forming apparatus 100 configured as described above operates as follows.

When image formation is started, the photoreceptors 2 in the respective process units 1 are rotated clockwise in FIG. 1, and the changing rollers 3 uniformly charge the surfaces of the photoreceptors 2 to a predetermined polarity. Then, the exposure unit 6 directs laser beams onto the charged surfaces of the respective photoreceptors 2 according to, for example, image data of originals read by a reading unit. Thus, electrostatic latent images are formed on the respective photoreceptors 2. More specifically, the exposure unit 6 directs the laser beams according to single color data, namely, yellow, cyan, magenta, and black color data decomposed from full-color image data to the surfaces of the photoreceptors 2. The electrostatic latent images formed on the photoreceptors 2 are developed into toner images with toner supplied by the respective development devices 4.

Meanwhile, the driving roller 9 rotates, and accordingly the intermediate transfer belt 8 rotates in the direction indicated by arrow Y1 shown in FIG. 1. The predetermined voltage (i.e., transfer bias voltage), polarity of which is the opposite that of toner, is applied to the respective primary-transfer rollers 11, thus forming transfer electrical fields in the primary-transfer nips between the primary-transfer rollers 11 and the photoreceptors 2. The transfer bias voltage may be a constant voltage or voltage controlled in constant-current control method. The transfer electrical fields generated in the primary-transfer nips transfer the toner images from the respective photoreceptors 2 and superimpose them one on another on the intermediate transfer belt 8. Thus, a multicolor toner image is formed on the intermediate transfer belt 8. After primary transfer, the cleaning blades 5 remove toner remaining on the respective photoreceptors 2.

Additionally, when image formation is started, the feed roller 16 rotates, thereby transporting the sheet P from the sheet cassette 15. Then, the registration rollers 19 forward the sheet P to the secondary-transfer nip formed between the secondary-transfer roller 12 and the intermediate transfer belt 8, timed to coincide with the multicolor toner image formed on the intermediate transfer belt 8. At that time, the transfer bias voltage whose polarity is opposite that of the toner image on the intermediate transfer belt 8 is applied to the secondary-transfer roller 12, and thus the transfer electrical field is formed in the secondary-transfer nip. The transfer electrical field generated in the secondary-transfer nip transfers the superimposed toner images from the intermediate transfer belt 8 onto the sheet P at a time. Subsequently, the sheet P enters the fixing device 20, and the toner image is fixed thereon. The pair of discharge rollers 17 discharges the sheet P onto the discharge tray 18.

It is to be noted that, although the description above concerns multicolor image formation, alternatively, the image forming apparatus 100 can form single-color images, bicolor images, or three-color images using one, two, or three of the four process units 1.

Figure 2:
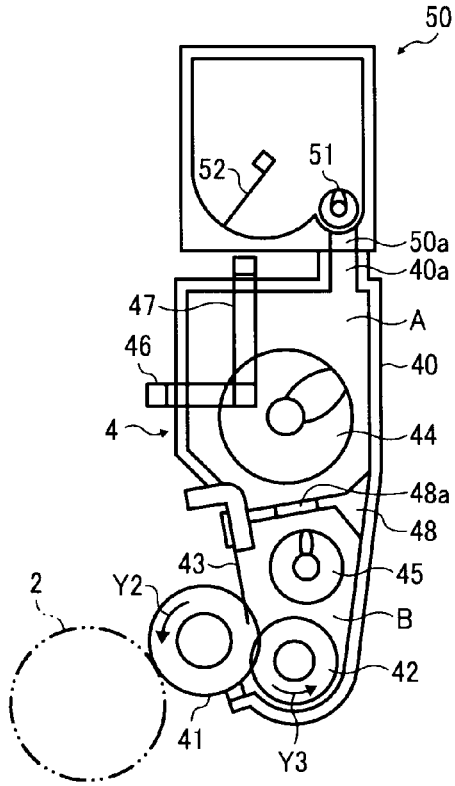
FIG. 2 is a schematic end-on axial view of a development device and a toner cartridge.
Figure 3:
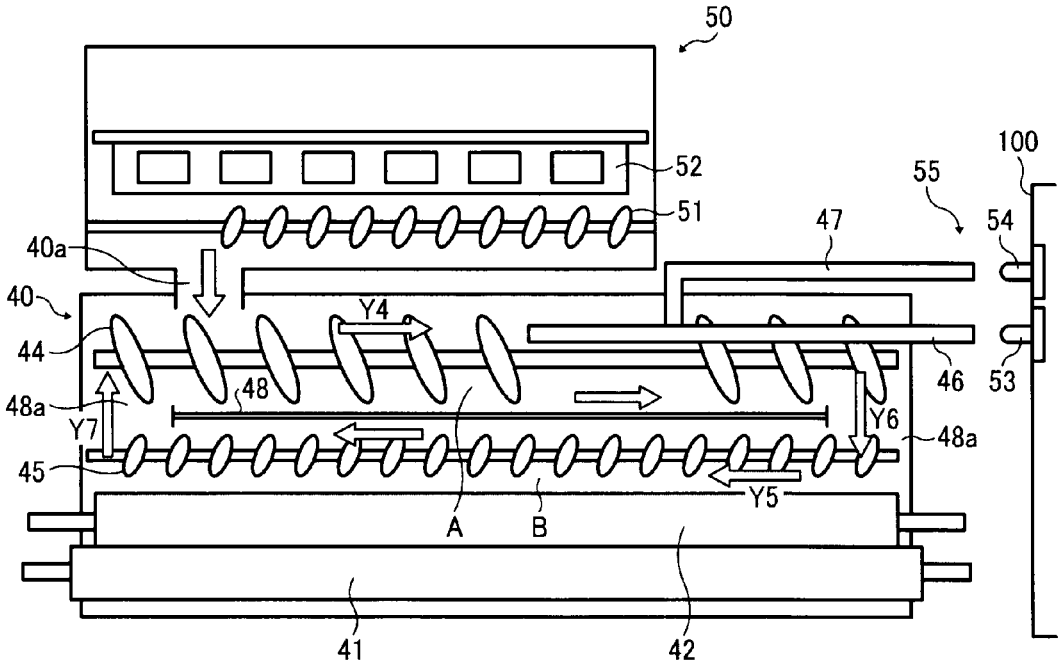
FIG. 3 is a cross-sectional view of the development device and the toner cartridge as viewed from a direction different from that of FIG. 2.

FIG. 2 is a schematic end-on axial view of the development device 4 and a toner cartridge 50. FIG. 3 is a schematic cross-sectional view of the development device 4 and the toner cartridge 50 perpendicular to the surface of the paper on which FIG. 2 is drawn.

As shown in FIG. 2, the development device 4 according to the present embodiment includes a development housing 40 in which first and second compartments A and B for containing developer are formed, a cylindrical development roller 41 serving as a developer bearer, a supply roller 42 serving as a developer supply member to supply toner to the development roller 41, a doctor blade 43 serving as a developer regulator to adjust the amount of toner carried on the development roller 41, and first and second developer conveyance members 44 and 45 to transport the developer (toner). It is to be noted that the term "cylindrical" used in this specification is not limited to round columns but also includes polygonal prisms.

The development roller 41 includes a metal core and an electroconductive elastic layer made of, for example, rubber, overlying the metal core. In the present embodiment, for example, the metal core has an external diameter of 6 mm, and the electroconductive elastic layer has an outer diameter of 12 mm and JIS hardness (Hs) of 75. Additionally, the electroconductive elastic layer is designed to have a volume resistivity of about $10^5\Omega$ to $10^7\Omega$. For example, electroconductive urethane rubber or silicone rubber may be used for the electroconductive elastic layer. The development roller 41 rotates counterclockwise in FIG. 2 as indicated by arrow Y2 and transports the toner carried thereon to a position facing the doctor blade 43 and a position facing the photoreceptor 2.

Typically, a sponge roller can be used as the supply roller 42. The sponge roller including a metal core and semiconducting foam polyurethane adhering to the metal core is suitable. Foam polyurethane can be made semiconducting by mixing carbon therein. In the present embodiment, the metal core of the supply roller 42 has an external diameter of about 6 mm, and the sponge layer has an external diameter of about 12 mm, for example. The supply roller 42 is disposed in contact with the development roller 41. The size of the nip formed between the supply roller 42 and the development roller 41 in contact with each other is typically about 1 mm to 3 mm. In the present embodiment, the nip has a length of about 2 mm. Additionally, the supply roller 42 rotates counterclockwise in FIG. 2 as indicated by arrow Y3 and can transport the toner in the development housing 40 to the outer layer of the development roller 41 efficiently by rotating in the counter direction to the direction in which the development roller 41 rotates. It is to be noted that, in the present embodiment, the ratio of rotational frequency of the supply roller 42 to that of the development roller 41 is 1 so that toner can be supplied reliably.

The doctor blade 43 can be constructed of, for example, a planar metal having a thickness of about 0.1 mm. Steel used stainless (SUS) metal may be used for the doctor blade 43. An end of the doctor blade 43 is disposed in contact with the surface of the development roller 41. When the toner passes through the nip between the doctor blade 43 and the development roller 41 (i.e., regulation nip), the amount (layer thickness) of the toner supplied by the supply roller 42 onto the development roller 41 is adjusted, and the toner is frictionally charged simultaneously. The amount of toner carried on the development roller 41 is adjusted for stable developability and satisfactory image quality. Accordingly, in commercial products, the pressure with which the doctor blade 43 contacts the development roller 41 and the position of the regulation nip are maintained strictly. For example, the contact pressure of the doctor blade 43 against the development roller 41 is about 20 N/m to 60 N/m, and the regulation nip is positioned about 0.5±0.5 mm from the tip of the doctor blade 43. These parameters can be determined in accordance with properties of toner, the development roller, and the supply roller. For example, in the present embodiment, the doctor blade 43 is constructed of a SUS metal having a thickness of 0.1 mm, disposed in contact with the development roller 41 with a pressure of 45 N/m, the regulation nip is positioned 0.2 mm from the tip of the doctor blade 43, and the length from a fixed end of the doctor blade 43 to the free end is 14 mm to form a uniform thin toner layer on the development roller 41.

Additionally, the toner cartridge 50 serving as a developer container is provided above the development housing 40 and removably connected thereto. It is to be noted that the development device 4 and the toner cartridge 50 are not limited to the configurations shown in FIG. 2. For example, the development device 4 and the toner cartridge 50 may be united as a single unit, or the development device 4, the toner cartridge 50, and the photoreceptor 2 may be housed in a common unit casing as a process unit.

A supply outlet (toner outlet) 50*a* is formed in a bottom portion of the toner cartridge 50, and a supply inlet (toner inlet) 40*a* is formed in an upper portion of the development housing 40 to supply toner from the toner cartridge 50 to the development housing 40. Additionally, a third developer conveyance member 51 and an agitator 52 are rotatably provided inside the toner cartridge 50. The third developer conveyance member 51 transports the toner inside the toner cartridge 50 to the toner outlet 50*a*. The agitator 52 transports the toner toward the third developer conveyance member 51.

Toner is supplied to the development housing 40 according to detection results by a developer amount detector 55 (shown in FIG. 3), described below, configured to detect the amount of toner remaining in the development housing 40. More specifically, when the toner amount detector 55 detects that the amount of toner inside the development housing 40 has decreased below a predetermined amount, the toner cartridge 50 is driven a predetermined period of time, thereby supplying a predetermined amount of toner to the development housing 40.

Additionally, a partition 48 divides, but not completely, the development housing 40 into the first compartment A in which the toner inlet 40*a* is positioned and the second compartment B in which the development roller 41, the doctor blade 43, and the like are provided. Openings 48*a* are formed in both end portions of the partition 48 as communication portions through which toner moves between the two compartments A and B. Dividing the development housing 40 with the partition 48 can reduce the powder pressure to the supply roller 42 by the toner, thus reducing the load to the supply roller 42. The first and second developer conveyance members 44 and 45 are positioned in the first and second compartments A and B, respectively.

As shown in FIG. 3, the first and second developer conveyance members 44 and 45 are positioned substantially facing each other via the partition 48 dividing the first compartment A and the second compartment B from each other.

The first compartment A and the second compartment B can communicate with each other via the openings 48*a* formed in both end portions of the partition 48. The first and second developer conveyance members 44 and 45 transport toner in the axial direction by rotation. More specifically, each of the first and second conveyance members 44 and 45 is a conveyance screw including a rotary shaft and a spiral-shaped screw blade formed on the rotary shaft. The first developer conveyance member 44 is described in further detail later.

Arrows Y4 through Y7 shown in FIG. 3 indicate the direction of movement of toner (developer). The first and second developer conveyance members 44 and 45 rotate to transport the toner in the opposite directions as indicated by arrows Y4 and Y5. The toner transported to an end portion of the first compartment A in the axial direction of the first developer conveyance member 44 cannot be transported further in that direction but be transported through the openings 48*a* to the second compartment B. Similarly, the toner transported to an end portion of the second compartment B in the axial direction of the second developer conveyance member 45 cannot be transported further in that direction but be transported through the openings 48*a* to the first compartment A. Then, the toner is transported by the first and second developer conveyance members 44 and 45 in the first and second compartments A and B to the opposite axial end portions, respectively, after which the toner is returned through the opening 48*a* to the compartment A or B where the toner was originally. The toner can be circulated between the first compartment A and the second compartment B by repeating this operation.

With the above-described configuration, while circulated between the first compartment A and the second compartment B, the toner supplied from the toner cartridge 50 to the first compartment A can be mixed with the toner present in the development housing 40. Thus, the ratio of supplied toner can be equalized. Accordingly, in the present embodiment, the development conditions can be kept constant even if fresh toner is supplied, preventing color unevenness and scattering of toner in the backgrounds of images.

Figure 8:
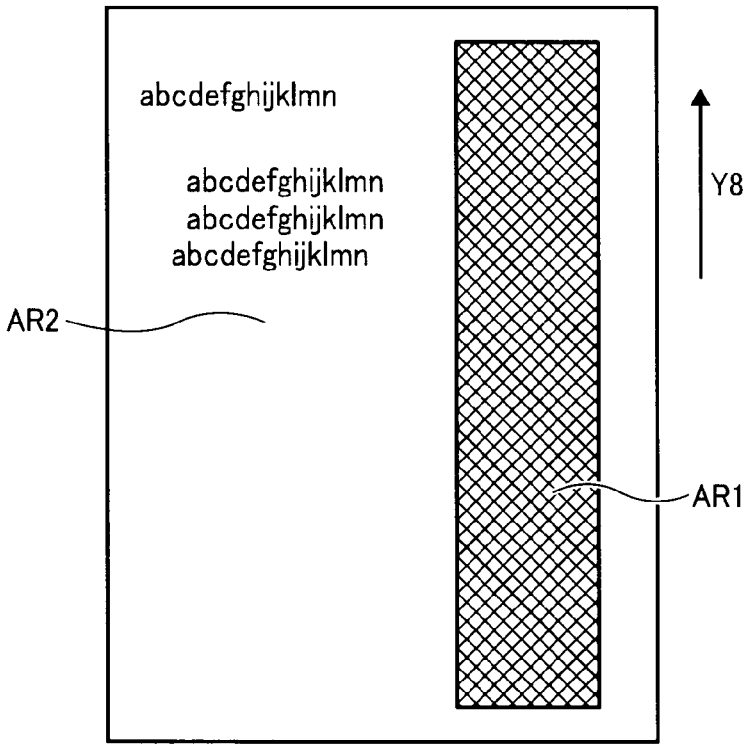
FIG. 8 is a plan view illustrating an image formed on a sheet that includes an area in which printing ratio is higher than other areas.
Figure 9:
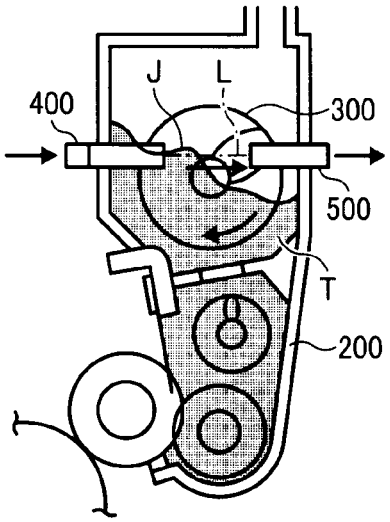
FIG. 9 RELATED ART
FIG. 9 is an end-on axial view of a development device that includes a developer conveyance screw and a developer amount detector according to a related art.

In some cases, the printing ratio in an image is not uniform as shown in FIG. 8, in which printing ratio is higher in an area AR1 than in an area AR2. If such images in which the high printing ratio area AR1 is locally present are printed consecutively, a greater amount of toner is consumed in the area corresponding to the high printing ratio area AR1. It is to be noted that arrow Y8 shown in FIG. 8 indicates the direction in which the sheet is transported.

Therefore, the toner inside the development device 4 is circulated so that the toner can be immediately transported to that area from other areas, thus preventing local shortage of toner. Additionally, circulating toner inside the development housing 40 can prevent the toner supplied thereto from accumulating immediately beneath the toner inlet 40*a*. Accordingly, the toner inlet 40*a* can be positioned on only one longitudinal side of the development housing 40, or the toner inlet 40*a* can be reduced in size. Thus, design flexibility of the apparatus can be enhanced, and the apparatus can be more compact.

Additionally, in configurations in which the developer containing compartment is divided with the partition 48 into the first compartment A and the second compartment B as in the present embodiment, flow of toner generated by the first developer conveyance member 44 and that generated by the second developer conveyance member 45 do not interfere with each other, securing smooth circulation of the toner. This can contribute to leveling the surface of the toner, enhancing accuracy of developer amount detection.

Additionally, if the distance from the toner inlet 40*a* to the second compartment B in which the development range is positioned is relatively long, the supplied toner and the toner inside the development housing 40 can be mixed a longer time. That is, if the toner inlet 40*a* is positioned in the first compartment A not the second compartment B, the supplied toner and the toner inside the development housing 40 can be mixed better. In particular, when the toner inlet 40*a* is positioned on the upstream side in the first compartment A in the developer conveyance direction, the supplied toner and the toner inside the development housing 40 can be mixed better.

The developer amount detector 55 is described in further detail below.

The developer amount detector 55 according to the present embodiment detects the amount of toner (developer) using an optical element in a light transmissive detection method. As shown in FIG. 3, the developer amount detector 55 includes a light-emitting element 53, a light-receiving element 54, first and second light guides 46 and 47. The light-emitting element 53 and the light-receiving element 54 together form an optical element and are provided to the apparatus body of the image forming apparatus 100. The first and second light guides 46 and 47 are provided to the development housing 40. The first and second light guides 46 and 47 are constructed of materials of good light permeability. For example, resins of high transparency, such as acrylic resin or polycarbonate can be used. Alternatively, optical glass, which has better optical characteristics, may be used for the first and second light guides 46 and 47. Yet alternatively, optical fibers may be used for the first and second light guides 46 and 47. In this case, design flexibility of the light path can be improved.

Figure 4:
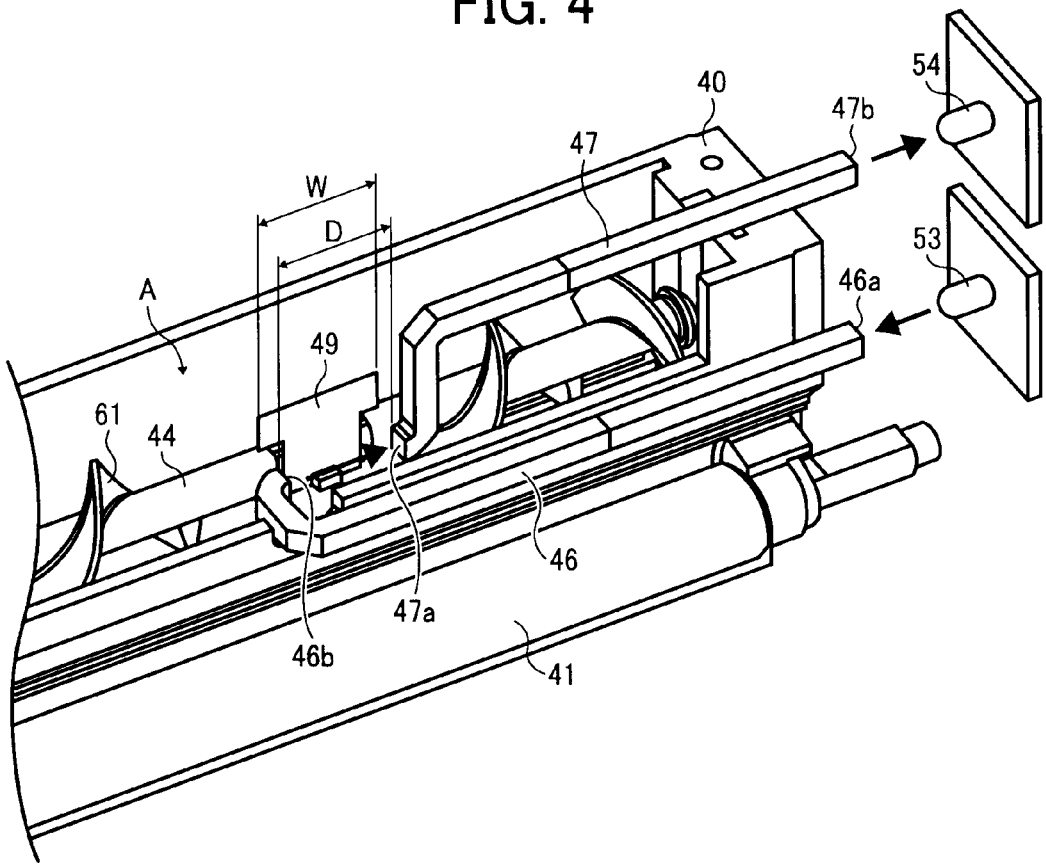
FIG. 4 is a perspective view of the development device in which the top side of a development housing is removed to illustrate locations of components such as light guides therein.

FIG. 4 is a perspective view of the first compartment A of the development device 4 in which the top side of the development housing 40 is removed to illustrate locations of the light guides 46 and 47 and the like.

As shown in FIG. 4, a first end portion including a first edge face 46*a* of the first light guide 46 is exposed outside the development housing 40 and is positioned to face the light-emitting element 53. By contrast, a second end portion including a second edge face 46*b* of the first light guide 46 is positioned in the first compartment A inside the development housing 40. Additionally, a first end portion including a first edge face 47*a* of the second light guide 47 is positioned in the first compartment A so that the first edge face 47*a* is at a predetermined distance from the second edge face 46*b* of the first light guide 46. By contrast, a second end portion including a second edge face 47*b* of the second light guide 47 is exposed from the development housing 40 and is positioned to face the light-receiving element 54.

The first light guide 46 is bent at two positions, and the light emitted from the light-emitting element 53 enters the first light guide 46 from the first edge face 46*a* and is reflected twice in the respective bent portions. Then, the light exits from the second edge face 46*b* of the first light guide 46. The second light guide 47 is bent at two positions similarly, and the light exited from the first light guide 46 enters the second light guide 47 from the first edge face 47*a* and is reflected twice in the respective bent portions. Then, the light exits from the second edge face 47*b* of the second light guide 47 and reaches the light-receiving element 54. When the amount of toner in the development housing 40 is sufficient, the light is blocked by the toner present in the gap between the second edge face 46*b* of the first light guide 46 and the first edge face 47*a* of the second light guide 47 facing each other. Thus, the light-receiving element 54 does not receive the light. However, as the toner is consumed in printing, the level of the toner in the development housing 40 descends below the first and second light guides 46 and 47, that is, no toner is present in the gap between the second edge face 46*b* of the first light guide 46 and the first edge face 47*a* of the second light guide 47. Accordingly, the light reaches the light-receiving element 54. The controller can recognize that the level of the toner in the development housing 40 is below the first and second light guides 46 and 47 with the value output from the light-receiving element 54 at that time.

When both the light-emitting element 53 and the light-receiving element 54 are positioned on the same side in the longitudinal direction of the development device 4 as in the present embodiment, the first and second light guides 46 and 47 can be shorter, which is advantageous in reducing the cost and size of the device. When the first and second light guides 46 and 47 are shortened, the light path formed thereby is reduced in length. Accordingly, the light-receiving element 54 can detect light even if the power of the light-emitting element 53 is reduced. Therefore, the cost of the light-emitting element 53 can be reduced.

Additionally, as shown in FIG. 4, a blade 49 is provided to the first developer conveyance member 44 at a position facing the gap between the second edge face 46*b* of the first light guide 46 and the first edge face 47*a* of the second light guide 47 in the axial direction of the first developer conveyance member 44. The blade 49 serves as a cleaner to clean the edge face 46*b* of the first light guides 46 and edge face 47*a* of the second light guide 47. The blade 49 is a flexible member and may be constructed of, for example, a polyethylene terephthalate (PET) sheet. The blade 49 has a width W, which is a length in the axial direction of the first developer conveyance member 44, slightly longer than a gap D between the second edge face 46*b* of the first light guide 46 and the first edge face 47*a* of the second light guide 47 facing it. With this configuration, as the first developer conveyance member 44 rotates, the blade 49 contacts both the second edge face 46*b* of the first light guide 46 and the first edge face 47*a* of the second light guide 47, removing toner adhering thereto. Thus, the light transmitted from the first light guide 46 to the second light guide 47 can be kept at a desirable level. It is to be noted that the blade 49 is not oblique to the rotary shaft 60 and is not capable of transporting toner axially, differently from the conveyance blade 61.

Figure 5:
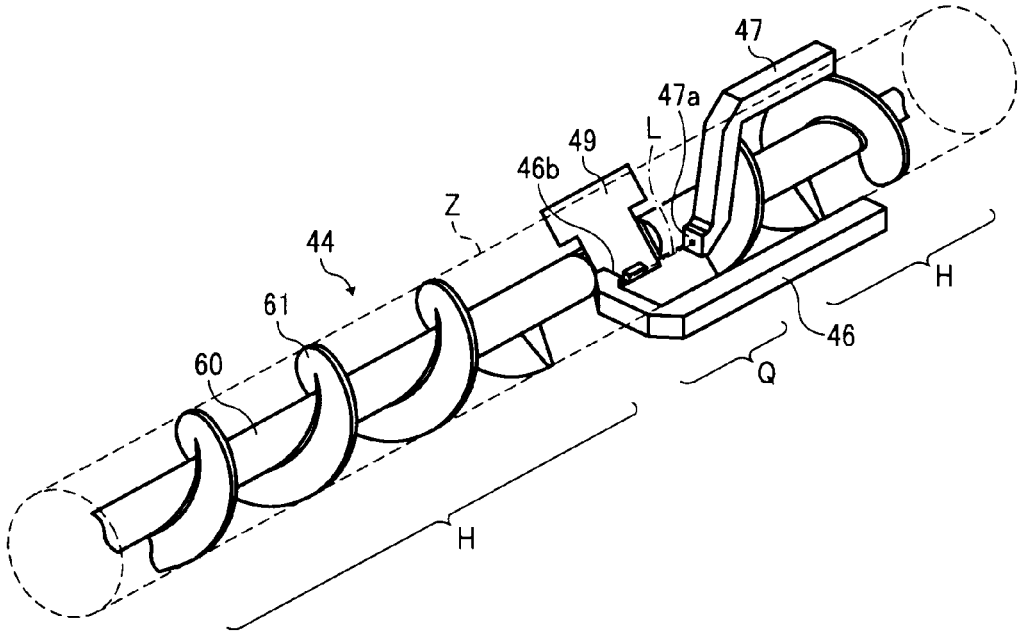
FIG. 5 illustrates relative positions of a first developer conveyance member and the respective light guides.

FIG. 5 illustrates relative positions of the first developer conveyance member 44 and the respective light guides 46 and 47.

As shown in FIG. 5, the first developer conveyance member 44 according to the present embodiment is a screw including the rotary shaft 60 and the spiral-shaped conveyance blade 61 winding around the rotary shaft 60, and the blade 49 extends in a partial axial area (length) Q of the rotary shaft 60. Additionally, in the partial area Q in the axial direction of the first developer conveyance member 44, the conveyance blade 61 is not present. The conveyance blade 61 is present only in areas H. The second edge face 46*b* of the first light guide 46 and the first edge face 47*a* of the second light guide 47, facing each other, are positioned within the partial length Q where the conveyance blade 61 is not provided.

With this configuration, a light transmission path L between the first and second light guides 46 and 47 can be positioned within a locus of rotation of the conveyance blade 61 indicated by broken lines Z shown in FIG. 5, and the first and second light guides 46 and 47 can be prevented from interfering with the conveyance blade 61. In other words, the light transmission path L between the first and second light guides 46 and 47 is positioned inside the outer circumference of the conveyance blade 61 when viewed in the axial direction of the rotary shaft 60.

It is to be noted that, although the entire light transmission path L formed between the first and second light guides 46 and 47 is within the locus of rotation in the configuration shown in FIG. 5, alternatively, only a part of the light transmission path L may be positioned inside the area defined by broken lines Z, that is, the locus of rotation of the conveyance blade 61. Additionally, the light transmission path L formed between the first and second light guides 46 and 47 substantially parallels the axis of the first developer conveyance member 44, that is, the direction in which the first developer conveyance member 44 transports toner.

Descriptions are given below of effects of the present embodiment.

Figure 6A:
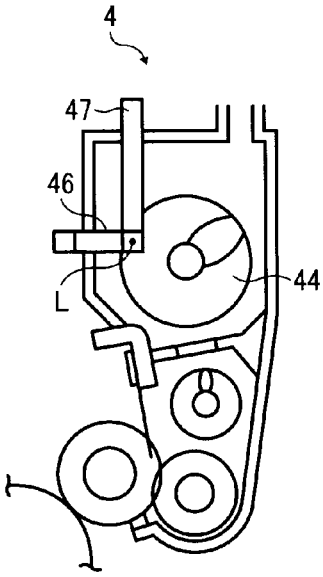
FIG. 6A illustrates the configuration according to the present embodiment.

FIG. 6A is an end-on axial view of the development device 4 according to the present embodiment.

In the development device 4, the light transmission path L formed between the first and second light guides 46 and 47 is positioned within the locus of rotation of the first developer conveyance member 44 and substantially in parallel to the axis thereof, perpendicular to the surface of the paper on which FIG. 6A is drawn.

Figure 6B:
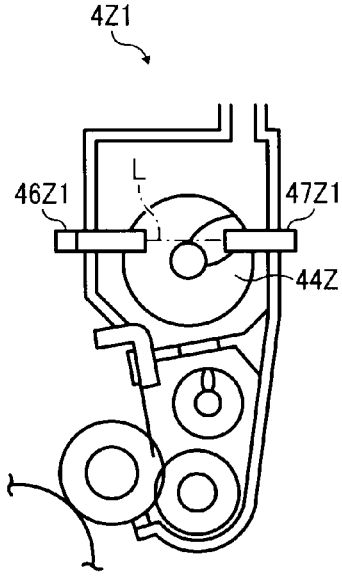
FIGS. 6B and 6C illustrate configurations according to comparative examples.

FIG. 6B is an end-on axial view of a development device 4Z1 according to a first comparative example. In the first comparative example, first and second light guides 46Z1 and 47Z1 are positioned so that a light transmission path L formed therebetween is substantially perpendicular to an axis of a first developer conveyance member 44Z, differently from the configuration shown in FIGS. 5 and 6A. The light transmission path L in the first comparative example, however, is within the locus of rotation of the first developer conveyance member 44Z similarly to the configuration shown in FIGS. 5 and 6A.

Figure 6C:
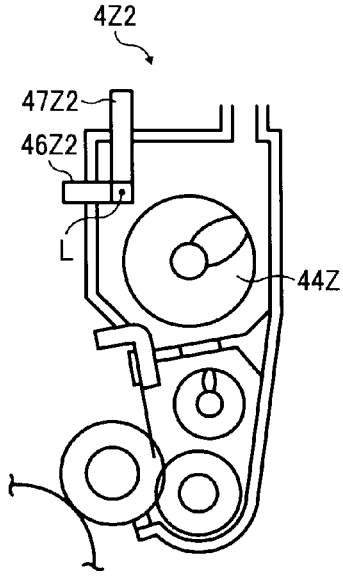

FIG. 6C is an end-on axial view of a development device 4Z2 according to a second comparative example. In the second comparative example, first and second light guides 46Z2 and 47Z2 are positioned so that a light transmission path L formed therebetween is outside the locus of rotation of a developer conveyance member 44Z, differently from the configuration shown in FIGS. 5 and 6A. The light transmission path L in the second comparative example, however, substantially parallels the axis of the developer conveyance member 44Z similarly to the configuration shown in FIGS. 5 and 6A.

To evaluate accuracy of developer amount detection in the above-described three development devices having different configurations, developer (i.e., toner) was put therein until the light transmission path L was covered with the toner. More specifically, reference amount of toner in the development devices 4 and 4Z1 according to the present embodiment and the first comparative example was 100 grams, and that in the second comparative example was 120 grams because the light transmission path L in the development device 4Z2 was positioned higher than those in the other development devices 4 and 4Z1. It is to be noted that the development devices 4, 4Z1, and 4Z2 have a similar configuration except the above-described differences. The toner amount was detected ten times in each of cases in which the toner amount was 20 grams smaller than the reference amount, 10 grams smaller than the reference amount, equal to the reference amount, and 10 grams greater than the reference amount. Table 1 shows the results of the evaluation.

TABLE 1

| | Embodiment | First comparative example | Second comparative Example |
|---|---|---|---|
| Toner reference amount | 100 g | 100 g | 120 g |

TABLE 1-continued

| | Embodiment | | First comparative example | | Second comparative Example | |
|---|---|---|---|---|---|---|
| Detection result | Toner present | No toner | Toner present | No toner | Toner present | No toner |
| Reference amount − 20 g | Zero | Ten times | Twice | Eight times | Four times | Six times |
| Reference amount − 10 g | Once | Nine times | Four times | Six times | Seven times | Three times |
| Reference amount | Ten times | Zero | Eight times | Twice | Ten times | Zero |
| Reference amount + 10 g | Ten times | Zero | Ten times | Zero | Ten times | Zero |

As shown in Table 1, in the development device 4 according to the present embodiment, when the toner amount contained therein was 20 grams smaller than the reference amount, the detection result was "no toner" in all of ten times of detection. When the toner amount contained therein was 10 grams smaller than the reference amount, the developer amount detector 55 determined that the toner was present only once, and the detection result was "no toner" in other nine times of detection. It is to be noted that the detection results "toner present" and "no toner" used in this specification mean that the amount of toner in the development device is greater than the reference amount and that the amount is less than the reference amount, respectively. When the toner amount in the development device 4 was 10 grams greater than the reference amount, the developer amount detector 55 determined that the toner was present in all of the ten times of detection. Thus, the number of times the detection result did not match the actual toner amount in the development device 4 according to the present embodiment was only once, which was generated in the case of the reference amount −10 grams.

By contrast, in the first comparative example, when the toner amount contained in the development device 4Z1 was 20 grams smaller than the reference amount, it was determined that toner was present twice among ten times of detection. When the toner amount contained in the development device 4Z1 was 10 grams smaller than the reference amount, it was determined that toner was present four times. Additionally, when the amount contained in the development device 4Z1 was equal to the reference amount, the detection result indicated "no toner" twice.

Thus, in the first comparative example, the detection result was improper more often than in the present embodiment. It can be assumed that the detection accuracy is lower because the light transmission path L between the first and second light guides 46Z1 and 47Z1 is disposed substantially perpendicular to the axial direction. More specifically, the surface of developer contained in the development device 4Z1 is not constant due to rotation of the first developer conveyance member 44Z as described above. Accordingly, if the light transmission path L is perpendicular to the axis of the first developer conveyance member 44Z, fluctuations in the surface of the developer can affect more the transmission of light, degrading accuracy of the developer amount detection.

In the second comparative example, in the cases in which the toner amount contained in the development device 4Z2 was equal to and 10 grams greater than the reference amount, it was determined that toner was present in all of the ten times of detection, which was consistent to the actual toner amount. However, in the cases in which the toner amount contained in the development device 4Z2 was 20 grams smaller than the reference amount and 10 grams smaller than the reference amount, it was erroneously determined that toner was present four times and seven times, respectively. It can be assumed that the developer amount detector erroneously detected that the toner amount was greater than the reference amount because the light transmission path L between the first and second light guides 46Z2 and 47Z2 was positioned outside the locus of rotation of the first developer conveyance member 44Z.

More specifically, in the second comparative example, in the configuration in which the light guides 46Z2 and 47Z2 and the screw-shaped first developer conveyance member 44Z are provided in the same area, the light guides 46Z2 and 47Z2 were disposed away from the screw to avoid interference between them. In such a configuration, however, it is possible that the effects by the screw for transporting and loosening toner are insufficient in areas adjacent to the light guides 46Z2 and 47Z2, resulting in coagulation of toner. Consequently, the coagulated toner blocks the light transmission path L, and the detector erroneously determined that there was a sufficient amount of toner even when the amount of toner was less than the reference amount.

From the detection results described above, in the present embodiment, the detection result is substantially consistent to the actual amount contained in the development device 4, and the degree of accuracy in developer amount detection is higher. In the arrangement in which the light transmission path L between the first and second light guides 46 and 47 is disposed along the axis of the first developer conveyance member 44, the surface of toner is not inclined to the direction of the light transmission path L. Accordingly, even if the surface of toner fluctuates as the first developer conveyance member 44 rotates, adverse effects to transmission of light in the light transmission path L can be smaller. It is assumed that these features of the above-described embodiment are effective to reduce tolerance of detection or erroneous detection.

Additionally, the detection accuracy can be improved because at least a part of the light transmission path L between the first and second light guides 46 and 47 is within the locus of rotation of the first developer conveyance member 44. In other words, the light transmission path L is at least partly disposed in an area where effects by the first developer conveyance member 44 to transport and loosen the developer are sufficient. Accordingly, toner can be inhibited from accumulating in the light transmission path L. Therefore, it is assumed that, in the present embodiment, the developer amount detector 55 can be prevented from erroneously determining that the toner amount is sufficient although the toner amount is less than the reference amount.

More specifically, when the surface of toner positioned between the first and second light guides 46 and 47 is stable, the detection accuracy can be higher. The above-described arrangement, that is, the light transmission path L between the first and second light guides 46 and 47 is positioned inside the locus of rotation of the first developer conveyance member 44, can loosen coagulated toner adjacent to the surface of toner between the first and second light guides 46 and 47, thus stabilizing the surface of toner. Accordingly, detection accuracy can be improved.

Additionally, in the above-described embodiment, the light transmission path L between the first and second light guides 46 and 47 is disposed between the areas H where the conveyance blade 61 is present as shown in FIG. 5. Accordingly, flow of toner can be generated upstream and downstream from the light transmission path L in the developer conveyance direction, and the surface of the toner can be stabilized effectively.

Additionally, the force for transporting toner is stronger in the conveyance path between the two openings 48*a* formed in the partition 48. Accordingly, when the light transmission path L between the first and second light guides 46 and 47 is positioned between the two openings 48*a*, the effects for transporting and loosening the toner in the light transmission path L can be sufficient. This configuration can reduce erroneous detection caused by the toner accumulating in the light transmission path L.

Although the above-described embodiment concerns screws including spiral blades, alternatively, the feature of the above-described embodiments can adapt to developer conveyance members configured otherwise.

Figure 7:
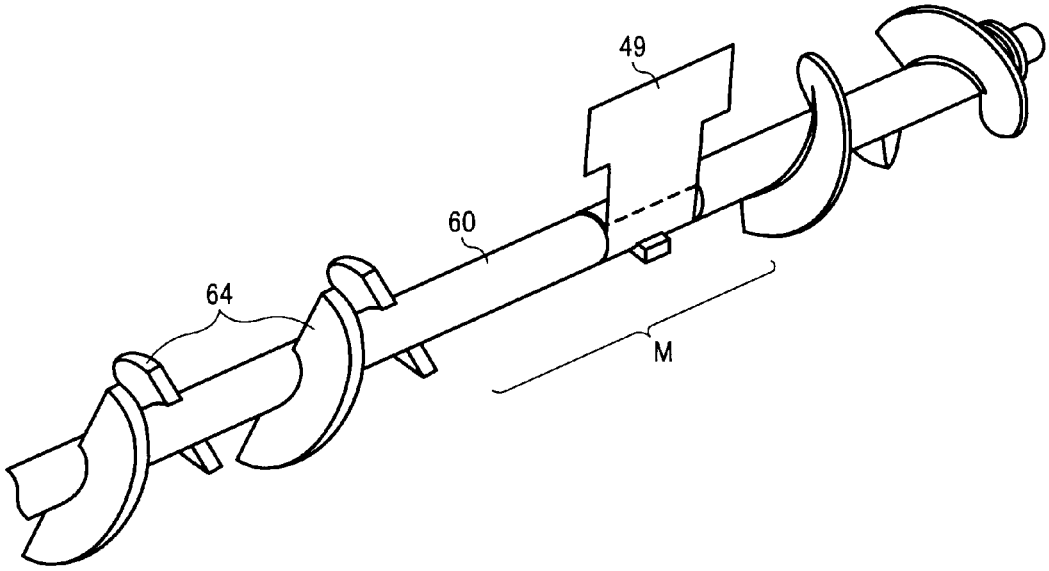
FIG. 7 illustrates a developer conveyance member according to a variation that includes planar fins provided to a rotary shaft.

For example, the above-described features of the present disclosure can adapt to a developer conveyance member shown in FIG. 7 that includes a rotary shaft 60 and planar fins 64 provided to the rotary shaft 60 as a variation. Specifically, in an area M (i.e., cutout M) along the rotary shaft 60, the fins 64 are not provided. The second edge face 46*b* (shown FIG. 5) of the first light guide 46 and the first edge face 47*a* (shown FIG. 5) of the second light guide 47 facing each other are disposed within the area M similarly to the configuration shown in FIG. 4 although first and second light guides 46 and 47 are not shown in FIG. 7. Other than that, the variation has a similar configuration to the above-described embodiment. In the configuration in which the discontinuous multiple fins 64 are provided to the rotary shaft 60, differently from the screw-like developer conveyance members, the possibility of clogging by toner is lower, and favorable toner conveyance capability can be maintained long time.

Additionally, the first and second light guides 46 and 47 may be provided in the second compartment B where the development roller 41 and the doctor blade 43 are positioned. However, providing the first and second light guides 46 and 47 in the first compartment A has the following advantages. In the area where the first and second light guides 46 and 47 are provided, the conveyance blade 61 of the developer conveyance member 44 is omitted. Therefore, toner conveyance capability is different between the area without the conveyance blade 61 and other areas where the conveyance blade 61 is provided, making the flow of toner uneven. If the flow of toner is not constant adjacent to the development roller 41, it can inhibit formation of uniform thin toner layer on the development roller 41, causing unevenness in image density.

Therefore, in order not to disturb the flow of toner in the second compartment B, where the development roller 41 is positioned, it is preferred that the first and second light guides 46 and 47 be provided in the first compartment A in which the development roller 41 is not positioned. In this case, unevenness in image density can be restricted. Moreover, providing the first and second light guides 46 and 47 in the first compartment A can increase design flexibility because the first and second light guides 46 and 47 are positioned away from the development roller 41, the doctor blade 43, and the supply roller 42.

Additionally, the above-described features of this disclosure can adapt to developer amount detectors provided in the toner cartridge 50 or other components than the development device 4.

Although the description above concerns configurations using one-component developer, the above-described features of this disclosure can adapt to image forming apparatuses using two-component developer consisting essentially of carrier (carrier particles) and toner (toner particles). Moreover, the image forming apparatus to which the features of this disclosure are applied is not limited to multicolor laser printers but may be printers of other types, copiers, facsimile machines, or multifunction machines having these capabilities.

As described above, even if the surface of the developer fluctuates and inclination thereof becomes unstable as the developer is transported, adverse effects caused by the fluctuations to the light transmission can be reduced. Additionally, the arrangement in which the light transmission path L is disposed within the locus of rotation of the developer conveyance member, where the toner conveyance and loosening effects are sufficient, can prevent the developer from blocking the light transmission path L when the amount of developer is less than the reference amount. Consequently, detection error and tolerance in detection can be reduced, securing a high degree of accuracy in the developer amount detection. Therefore, insufficient image density due to shortage of toner can be prevented or reduced. Additionally, replacement of toner cartridges in which a sufficient amount of toner still remain can be prevented.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a development housing;

a first developer conveyance member disposed in the development housing to transport by rotation developer contained in the development housing;

a developer bearer to carry by rotation the developer contained in the development housing to a development range facing a latent image bearer; and a developer amount detector to detect an amount of the developer contained in the development housing, the developer amount detector including, a light-emitting element, a light-receiving element, a first light guide including a first end into which light emitted from the light-emitting element enters, and a second end positioned inside the development housing and from which light in the first light guide exits, and a second light guide including a first end positioned inside the development housing facing the second end of the first light guide across a predetermined distance, and a second end from which light in the second light guide exits, wherein at least one of the second end of the first light guide and the first end of the second light guide is stationary, wherein the second end of the first light guide and the first end of the second light guide are arranged in an axial direction of the first developer conveyance member, forming a light transmission path therebetween, and wherein at least a part of the light transmission path is positioned inside a locus of rotation of the first developer conveyance member.

2. The development device according to claim 1, wherein the first developer conveyance member comprises:

a rotary shaft; and a conveyance blade provided to the rotary shaft, the conveyance blade including a cutout extending from an outer circumference of the conveyance blade to the rotary shaft, wherein the second end of the first light guide, the first end of the second light guide, and the light transmission path formed therebetween are positioned inside the cutout.

3. The development device according to claim 2, wherein the conveyance blade of the first developer conveyance member comprises a spiral-shaped screw blade winding around the rotary shaft.

4. The development device according to claim 2, wherein the conveyance blade of the first developer conveyance member comprises discontinuous multiple sub-blades positioned oblique to the rotary shaft.

5. The development device according to claim 1, wherein the first developer conveyance member comprises a cleaning blade positioned to contact at least one of the second end of the first light guide and the first end of the second light guide.

6. The development device according to claim 5, wherein the cleaning blade has a length in the axial direction of the first developer conveyance member longer than the predetermined distance between the second end of the first light guide and the first end of the second light guide and overlaps the light transmission path formed therebetween in the axial direction of the first developer conveyance member.

7. The development device according to claim 6, wherein the first developer conveyance member comprises:

a rotary shaft; and a conveyance blade provided to the rotary shaft, the conveyance blade including a cutout extending from an outer circumference of the conveyance blade to the rotary shaft, wherein the second end of the first light guide, the first end of the second light guide, and the light transmission path formed therebetween are positioned inside the cutout.

8. The development device according to claim 1, further comprising:

a partition to divide at least partly the development housing into a first compartment in which the first developer conveyance member is provided and a second compartment; and a second developer conveyance member provided in the second compartment to transport the developer contained in the development housing in a direction opposite a direction in which the first developer conveyance member transports the developer contained in the development housing, wherein the developer contained in the development housing is circulated through two communication portions between the first and second compartments.

9. The development device according to claim 8, wherein the light transmission path formed between the second end of the first light guide and the first end of the second light guide is positioned between the two communication portions.

10. The development device according to claim 8, wherein the developer bearer is provided in the second compartment, and the first and second light guides are provided in the first compartment.

11. The development device according to claim 8, wherein a developer supply inlet is formed in the development housing.

12. The development device according to claim 1, wherein the light-emitting element and the light-receiving element of the developer amount detector are provided outside the development housing.

13. The development device according to claim 1, wherein the first end of the first light guide and second end of the second light guide are positioned on a same side in the axial direction of the first developer conveyance member.

14. A developer container for containing developer, comprising:

a developer conveyance member to transport by rotation developer in the developer container; and a developer amount detector to detect an amount of developer contained in the developer container, the developer amount detector including a light-emitting element to emit light, a light-receiving element, a first light guide including a first end into which light emitted from the light-emitting element enters and a second end positioned inside the developer container and from which light in the first light guide exits, and a second light guide including a first end positioned inside the developer container facing the second end of the first light guide across a predetermined distance to receive light from the first light guide, and a second end from which light in the second light guide exits, wherein at least one of the second end of the first light guide and the first end of the second light guide is stationary, wherein the second end of the first light guide and the first end of the second light guide are arranged in an axial direction of the developer conveyance member, forming a light transmission path therebetween, and wherein at least a part of the light transmission path is positioned inside a locus of rotation of the developer conveyance member.

15. An image forming apparatus comprising:

a latent image bearer on which a latent image is formed; and a development device to develop the latent image formed on the latent image bearer with developer, the development device including:

a developer container;

a first developer conveyance member disposed in the developer container to transport by rotation developer contained in the developer container;

a developer bearer to carry by rotation the developer contained in the developer container to a development range facing a latent image bearer; and a developer amount detector to detect an amount of developer contained in the developer container, the developer amount detector including, a light-emitting element to emit light, a light-receiving element, a first light guide including a first end into which the light emitted from the light-emitting element enters, and a second end positioned inside the developer container and from which light in the first light guide exits, and a second light guide including a first end positioned inside the developer container facing the second end of the first light guide across a predetermined distance to receive light from the first light guide, and a second end from which light exits the second light guide exits, wherein at least one of the second end of the first light guide and the first end of the second light guide is stationary, wherein the second end of the first light guide and the first end of the second light guide are arranged in an axial direction of the first developer conveyance member, forming a light transmission path therebetween, and wherein at least a part of the light transmission path is positioned inside a locus of rotation of the first developer conveyance member.

16. The image forming apparatus according to claim 15, wherein the development device and the latent image bearer are housed in a common unit casing as a process unit.

17. The development device according to claim 1, further comprising a cleaning blade attached to the first developer conveyance member, wherein the cleaning blade rotates with first developer conveyance member relative to the least one of the second end of the first light guide and the first end of the second light guide that is stationary and contacts at least one of the second end of the first light guide and the first end of the second light guide.

18. A developer container for containing developer, comprising:

a developer conveyance member to transport by rotation the developer in the developer container; and a developer amount detector to detect an amount of developer contained in the developer container, the developer amount detector including a light-emitting element to emit light, a light-receiving element, a first light guide including a first end into which light emitted from the light-emitting element enters, and a second end positioned inside the developer container and from which light in the first light guide exits, and a second light guide including a first end positioned inside the developer container facing the second end of the first light guide across a predetermined distance to receive light from the first light guide, and a second end from which light in the second light guide exits, wherein the second end of the first light guide and the first end of the second light guide are arranged in an axial direction of the developer conveyance member, forming a light transmission path therebetween, wherein at least a part of the light transmission path is positioned inside a locus of rotation of the developer conveyance member, and wherein the first end of the first light guide and second end of the second light guide are positioned on a same side in the axial direction of the developer conveyance member.

* * * * *